US011173712B2

(12) United States Patent
Martin et al.

(10) Patent No.: US 11,173,712 B2
(45) Date of Patent: Nov. 16, 2021

(54) SENSE MEASUREMENTS FOR FLUIDIC ACTUATORS

(71) Applicant: Hewlett-Packard Development Company, L.P., Spring, TX (US)

(72) Inventors: Eric T. Martin, Corvallis, OR (US); Daryl E. Anderson, Corvallis, OR (US); James R. Przybyla, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/970,470

(22) PCT Filed: Apr. 6, 2018

(86) PCT No.: PCT/US2018/026541

§ 371 (c)(1),
(2) Date: Aug. 17, 2020

(87) PCT Pub. No.: WO2019/194828

PCT Pub. Date: Oct. 10, 2019

(65) Prior Publication Data

US 2021/0016565 A1 Jan. 21, 2021

(51) Int. Cl.
*B41J 2/125* (2006.01)
*B41J 2/045* (2006.01)

(52) U.S. Cl.
CPC ..... *B41J 2/125* (2013.01); *B41J 2/0451* (2013.01)

(58) Field of Classification Search
CPC .. B41J 2/14153; B41J 2/0458; B41J 2/04543; B41J 2/0451; B41J 2/04541; B41J 2/04573; B41J 2/125; B41J 2/04586
See application file for complete search history.

(56) References Cited

U.S. PATENT DOCUMENTS

| | | | |
|---|---|---|---|
| 6,130,683 | A | 10/2000 | Ju |
| 6,257,694 | B1 | 7/2001 | Tokumaru et al. |
| 6,616,256 | B1 | 9/2003 | Cook et al. |
| 6,659,581 | B2 | 12/2003 | Schloeman et al. |

(Continued)

FOREIGN PATENT DOCUMENTS

| | | |
|---|---|---|
| EP | 1029674 | 8/2000 |
| EP | 1413435 | 4/2004 |

(Continued)

*Primary Examiner* — Jannelle M Lebron
(74) *Attorney, Agent, or Firm* — Trop Pruner & Hu PC

(57) ABSTRACT

In some examples, a system includes a device support to receive a fluid dispensing device, and a controller to identify, based on data controlling activation of fluidic actuators, a fluidic actuator that is to be activated in a first activation cycle of a group of activation cycles that correspond to activation intervals of respective fluidic actuators of a group of fluidic actuators of the fluid dispensing device, the identified fluidic actuator being part of the group of fluidic actuators. To perform a sense measurement for the identified fluidic actuator, the controller suppresses activation of the identified fluidic actuator in the first activation cycle, and causes activation of the identified fluidic actuator in a sense measurement cycle different from the first activation cycle, the sense measurement cycle being part of the group of activation cycles.

15 Claims, 5 Drawing Sheets

(56) References Cited

U.S. PATENT DOCUMENTS

| | | | | |
|---|---|---|---|---|
| 6,698,862 | B1 * | 3/2004 | Choi | B41J 2/04541 347/17 |
| 7,490,919 | B2 | 2/2009 | Combs et al. | |
| 7,635,174 | B2 | 12/2009 | Bergstedt et al. | |
| 8,708,449 | B2 | 4/2014 | Shinkawa | |
| 8,899,711 | B2 | 12/2014 | Masuda et al. | |
| 9,493,002 | B2 | 11/2016 | Edelen et al. | |
| 9,776,395 | B2 | 10/2017 | Anderson et al. | |
| 2006/0125858 | A1 | 6/2006 | Silverbrook et al. | |
| 2008/0084444 | A1 | 4/2008 | Sheahan et al. | |
| 2010/0231625 | A1 | 9/2010 | Walmsley et al. | |
| 2011/0084997 | A1 | 4/2011 | Chen et al. | |
| 2013/0278656 | A1 | 10/2013 | Govyadinov et al. | |
| 2013/0278657 | A1 | 10/2013 | Martin et al. | |
| 2014/0210881 | A1 | 7/2014 | Van Brocklin et al. | |
| 2016/0271940 | A1 * | 9/2016 | Martin | B41J 2/04541 |
| 2017/0225455 | A1 | 8/2017 | Veenstra et al. | |

FOREIGN PATENT DOCUMENTS

| | | |
|---|---|---|
| EP | 1221372 | 6/2005 |
| WO | WO-2019194828 | 10/2019 |
| WO | WO-2019194829 | 10/2019 |
| WO | WO-2019194831 | 10/2019 |
| WO | WO-2019194832 | 10/2019 |
| WO | WO-2019194834 | 10/2019 |

* cited by examiner

SENSE MEASUREMENTS FOR FLUIDIC ACTUATORS

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
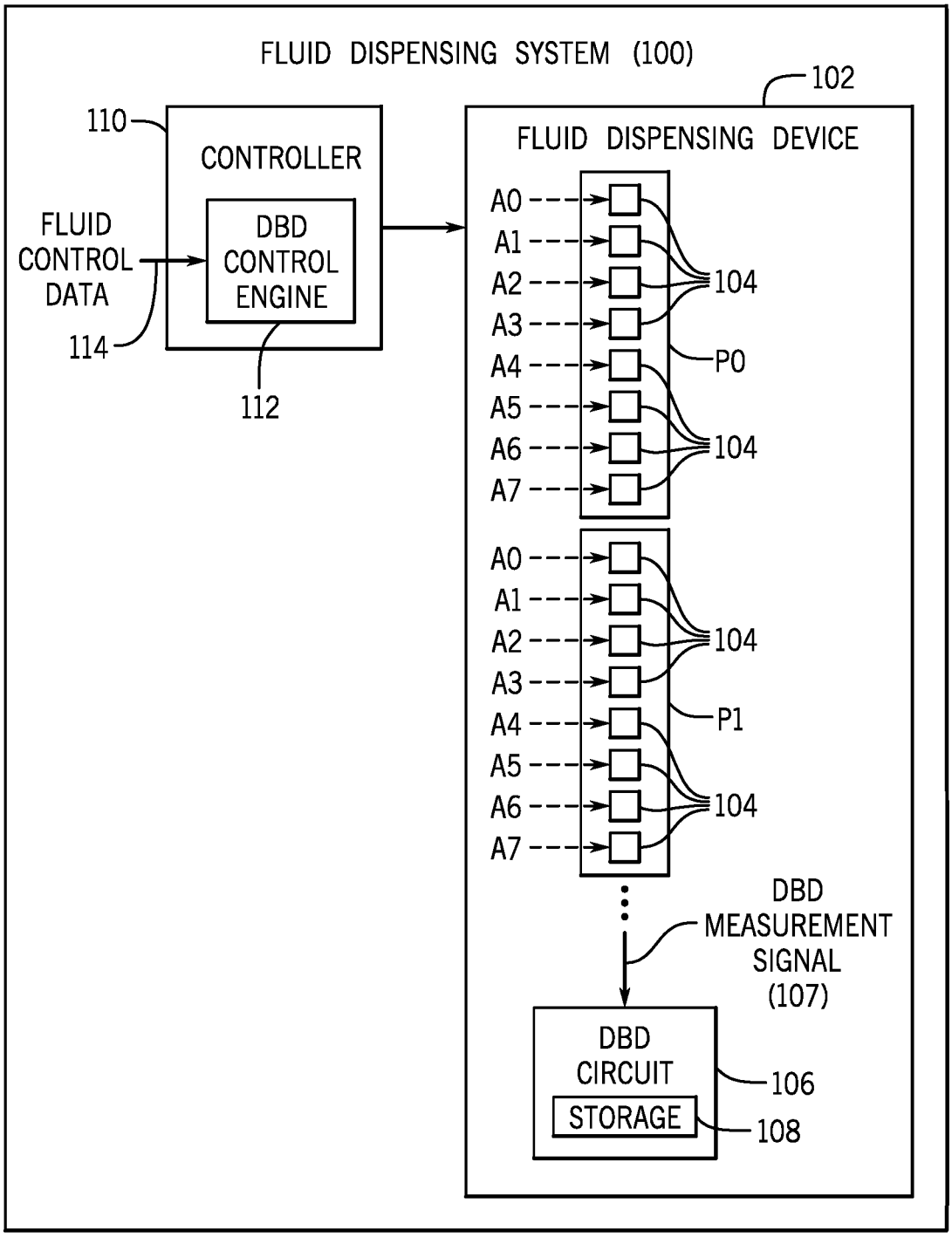
FIG. 1 is a block diagram of a fluid dispensing system including a controller according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

Generally, a fluidic actuator can be an ejecting-type fluidic actuator to cause ejection of a fluid, such as through an orifice of a nozzle, or a non-ejecting-type fluidic actuator to cause flow of a fluid.

Activating a fluidic actuator can also be referred to as firing the fluidic actuator. In some examples, the fluidic actuators include thermal-based fluidic actuators including heating elements, such as resistive heaters. When a heating element is activated, the heating element produces heat that can cause vaporization of a fluid to cause nucleation of a vapor bubble (e.g., a steam bubble) proximate the thermal-based fluidic actuator that in turn causes dispensing of a quantity of fluid, such as ejection from an orifice of a nozzle or flow through a fluid conduit or fluid chamber. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a firing chamber. In addition, a nozzle can include an orifice through which fluid is dispensed, a fluidic actuator, and a sensor. Each fluid chamber provides the fluid to be dispensed by the respective nozzle. Prior to a droplet release, the fluid in the fluid chamber is restrained from exiting the nozzle due to capillary forces and/or back-pressure acting on the fluid within the nozzle passage.

During a droplet release from a nozzle, the fluid within the fluid chamber is forced out of the nozzle by actively increasing the pressure within the fluid chamber. In some example fluid dispensing devices, a resistive heater positioned within the fluid chamber when activated vaporizes a small amount of at least one component of the fluid. In some cases, a major component of the fluid (such as liquid ink for printing systems or other types of fluids) is water, and the resistive heater vaporizes the water. The vaporized fluid component expands to form a gaseous drive bubble within the fluid chamber. This expansion exceeds a restraining force on the fluid within the fluid chamber enough to expel a quantity of fluid (a single fluid droplet or multiple fluid droplets) out of the nozzle. Generally, after the release of fluid droplet, the pressure in the fluid chamber drops below the strength of the restraining force and the remainder of the fluid is retained within the fluid chamber. Meanwhile, the drive bubble collapses and fluid from a reservoir for the fluid dispensing device flows into the fluid chamber to replenish the lost fluid volume resulting from the fluid droplet release. The foregoing process is repeated each time the nozzle of the fluid dispensing device is instructed to fire.

In other examples with non-ejecting fluidic actuators, the drive bubble formed by activation of a non-ejecting fluidic actuator causes movement of fluid through a fluid conduit or fluid chamber.

After repeated use of the fluidic actuators of a fluid dispensing device, the fluidic actuators or flow structures associated with the fluidic actuators may develop defects (e.g., a nozzle, fluid conduit, or fluid chamber may become clogged, a fluidic actuator may malfunction, etc.) and hence may not operate in a target manner. As a result, fluid dispensing performance of the fluidic actuators may degrade over time and use.

In some examples, fluidic actuator health can be determined by performing drive bubble detection (DBD) measurements for each fluidic actuator. DBD measurements can allow for detection of characteristics of a drive bubble and a fluid in a fluid chamber or fluid channel. From these characteristics, qualities of the drop ejected or fluid moved can be inferred, so that servicing or replacement of a degraded fluid dispensing device can be performed.

Although reference is made to DBD measurements in some examples, it is noted that techniques or mechanisms according to some implementations of the present disclosure can also be applied to other types of sense measurements of fluidic actuators. A sense measurement of a fluidic actuator refers to measuring a characteristic of the fluidic actuator and/or flow structure associated with the fluidic actuator for determining a condition of the fluidic actuator and/or flow structure.

A fire event can refer to a signal or other indication that is provided to activate a fluidic actuator. A fire event to activate a fluidic actuator can refer to a fire event to activate a single fluidic actuator or a group of fluidic actuators. In some examples, a DBD measurement for a fluidic actuator is performed in response to a fire event. In some cases, to obtain multiple DBD measurements for a fluidic actuator, the fluidic actuator can be fired multiple times in response to respective multiple fire events.

In some examples, activating a fluidic actuator to perform a DBD measurement can cause ejection of a fluid droplet from a corresponding nozzle or cause other dispensing of an amount of fluid, which can lead to increased fluid usage. Also, in printing applications, ejection of a fluid droplet during a sense measurement can lead to the fluid droplet being deposited onto a print medium or other print target, which may be undesirable since the fluid droplet can cause a noticeable artifact on the print medium or other print target.

In accordance with some implementations of the present disclosure, extra ejection or flow of fluid from nozzles or other flow structures subject to sense measurements (e.g., DBD measurements) can be suppressed by identifying, based on data controlling activation of fluidic actuators of a fluid dispensing device, a fluidic actuator of the fluid dispensing device that is to be activated in a given activation cycle of a group of activation cycles that correspond to activation intervals of respective fluidic actuators of a group of fluidic actuators. To perform the sense measurement of the identified fluidic actuator, activation of the identified fluidic actuator in the given activation cycle is suppressed, and activation of the identified fluidic actuator in a sense measurement cycle different from the given activation cycle is performed, where the sense measurement cycle is part of the group of activation cycles.

FIG. 1 is a block diagram of a fluid dispensing system 100, according to some examples. The fluid dispending system 100 can be a printing system, such as a 2D printing system or a 3D printing system. In other examples, the fluid dispending system 100 can be a different type of fluid dispensing system. Examples of other types of fluid dispensing systems include those used in fluid sensing systems, medical systems, vehicles, fluid flow control systems, and so forth.

The fluid dispensing system 100 includes a fluid dispensing device 102 for dispensing fluid. In a 2D printing system, the fluid dispensing device 102 includes a printhead that ejects printing fluid (e.g., ink) onto a print medium, such as a paper medium, a plastic medium, and so forth.

In a 3D printing system, the fluid dispensing device 102 includes a printhead that can eject any of various different printing fluids onto a print target, where the printing fluids can include any or some combination of the following: ink, an agent used to fuse powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

In some examples, the fluid dispensing device 102 can be a fluid dispensing die. A "die" refers to an assembly where various layers are formed onto a substrate to fabricate circuitry, fluid chambers, and fluid conduits.

The fluid dispensing device 102 includes an array of fluidic actuators 104. The array of fluidic actuators 104 can include a column of fluidic actuators, or multiple columns of fluidic actuators. The fluidic actuators 104 can be organized into multiple primitives, where each primitive includes a specified number of fluidic actuators. FIG. 1 shows primitives P0 and P1. Each primitive P0 or P1 includes 8 fluidic actuators. In other examples, a primitive can include a different number of fluidic actuators. Also, the array of fluidic actuators 104 can include more than two primitives.

The fluidic actuators 104 can be part of nozzles or can be associated with other types of flow structures, such as fluid conduits, fluid chambers, and so forth. Each fluidic actuator is selected by a respective different address. Thus, in the example of FIG. 1, the fluidic actuators in the nozzles of the primitive P0 are selected by respective addresses A0-A7, and similarly, the fluidic actuators in the nozzles of the primitive P1 are selected by respective addresses A0-A7.

In some examples, fluidic and electrical constraints can prevent firing of all of the fluidic actuators 104 simultaneously. To fire all the fluidic actuators, data (e.g., in the form of a first data packet) is loaded to activate all fluidic actuators in the primitives for a first address (e.g., A0), then data (e.g., in the form of a second data packet) is loaded to activate all fluidic actuators selected by a second address (e.g., A1), and so forth. A data packet for each address is referred to as a fire pulse group (FPG). A set of FPGs, including one FPG for each address, is referred to as a column group.

More generally, an FPG is referred to as an "activation cycle," and a column group is referred to as a group of activation cycles that correspond to different addresses (e.g., A0-A7).

In the example of FIG. 1, the 8 fluidic actuators of each primitive can be activated in the respective 8 FPGs of a column group (or more generally, the respective 8 activation cycles of a group of activation cycles).

In FIG. 1, the fluid dispensing device 102 further includes a DBD circuit 106. The DBD circuit 106 can receive a DBD measurement signal 107 output by a sensor (that is associated with an activated fluidic actuator) of a nozzle (or other flow structure) that is subjected to a DBD measurement. In examples where the fluid dispensing device 102 includes nozzles, the nozzles can include respective sensors. In other examples, the sensors can be included in other flow structures through which fluid can be dispensed by activations of respective fluidic actuators.

A sensor includes a fluid property sensor to measure a fluid property of the nozzle or other flow structure. The sensor can measure a fluid property concurrent with activation of an associated fluidic actuator. In examples where a fluidic actuator is a thermal based fluidic actuator, the sensor can be used (via sense circuits) to sense a fluid property during formation and collapse of a vapor bubble.

In other examples where the fluidic actuator is a piezoelectric membrane based fluidic actuator, the sensor may be used (via sense circuits) to sense a fluid property during actuation of the piezoelectric membrane that causes ejection or other movement of a quantity of fluid.

In some examples, a sensor can include an impedance sensor to measure variations in the impedance associated with a nozzle or other flow structure due to formation of a drive bubble. In other examples, other types of sensors can be used to measure characteristics of the nozzle or other flow structure due to formation of a drive bubble.

In an example, if a first fluidic actuator of the primitive P0 (which can be any of the fluidic actuators selected by addresses A0-A7) is the subject of a DBD measurement, then the DBD circuit 106 receives the DBD measurement signal 107 from the sensor associated with the first fluidic actuator of the primitive P0. Similarly, if a second fluidic actuator of the primitive P1 (which can be any of the fluidic actuators selected by addresses A0-A7) is the subject of a DBD measurement, then the DBD circuit 106 receives the DBD measurement signal 107 from the sensor associated with the second fluidic actuator in the primitive P1.

In some examples, just one fluidic actuator is selected per array of fluidic actuators 104 for performing a DBD measurement. In other examples, more than one fluidic actuator can be selected for DBD measurement in an array of fluidic actuators 104.

The DBD circuit 106 includes a storage 108 to store a value corresponding to the DBD measurement signal 107 received from the sensor associated with the fluidic actuator that is subject to the DBD measurement. The storage 108 can be a memory, a storage capacitor, a latch, a register, or any other type of storage element.

The storage 108 can store an analog signal corresponding to the DBD measurement signal 107, or a digital value based on the DBD measurement signal 107. To produce a digital value, for example, the DBD circuit 106 can include a comparator (not shown) to compare the DBD measurement signal 107 from a sensor of a nozzle that is the subject of a DBD measurement, to a specified threshold. The output of the comparator can then be provided to an analog-to-digital (ADC) converter to convert into a digital value that can be stored in the storage 108. In other examples, other ways of producing a digital value based on the DBD measurement signal 107 can be performed.

The fluid dispensing system 100 also includes a controller 110 that can control the operation of the fluidic actuators 104 of the fluid dispensing device 102. As used here, a "controller" can refer to a hardware processing circuit or a combination of a hardware processing circuit and machine-readable instructions executable on the hardware processing circuit. A hardware processing circuit can include any or some combination of the following: a microprocessor, a core of a multi-core microprocessor, a microcontroller, a programmable integrated circuit, a programmable gate array, or another hardware processing circuit.

The controller 110 includes a DBD control engine 112 that is able to suppress dispensing of an extra amount of fluid when performing DBD measurements, in accordance with some implementations of the present disclosure. The DBD control engine 112 can be implemented as a portion of the hardware processing circuit of the controller 110, or as machine-readable instructions executable on the controller 110.

The controller 110 receives fluid control data 114, which controls (schedules) which of the fluidic actuators of the array of fluidic actuators 104 of the fluid dispensing device 102 are to be activated (and which other fluidic actuators are to remain inactive). In a printing system, the fluid control data 114 includes image data that schedules the dispensing of fluid from nozzles in forming an image on a print medium (for 2D printing) or in forming a 3D object (for 3D printing) during a print operation. Alternatively, the fluid control data 114 can schedule the activation of pumps or other fluidic actuators to cause flow of a fluid, such as to distribute pigment particles and so forth.

Figure 2:
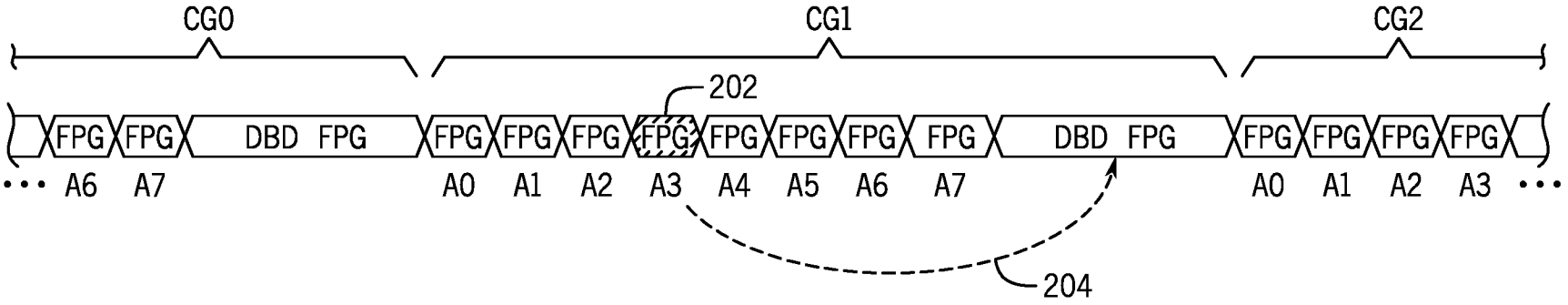
FIGS. 2 and 3 are timing diagrams illustrating groups of activation intervals, with each group of activation intervals including a sense measurement interval according some examples.

FIG. 2 is a timing diagram that shows multiple column groups CG0, CG1, and CG2. As noted above, each column group includes a sequence of FPGs, including multiple FPGs that corresponding to respective addresses A0-A7. Such FPGs can be referred to as "normal FPGs" since respective fluidic actuators are selected for activation based on the fluid control data 114 in these FPGs. The series of FPGs in each column group further includes a DBD FPG, which is used to activate a fluidic actuator that is the subject of a DBD measurement. The DBD FPG is an extra FPG added to a column group in addition to the normal FPGs that correspond to addresses A0-A7.

For example, for the column group CG1, 8 normal FPGs are used to activate 8 respective fluidic actuators of a respective primitive (e.g., primitive P1 in FIG. 1) using respective different addresses A0-A7 (assuming the fluid control data 114 specifies that the fluidic actuators of CG1 are to be activated). The column group CG1 further includes a DBD FPG at the end of the 8 normal FPGs.

Primitive data (also referred to as "fire data") to control activation or non-activation of fluidic actuators is provided in each FPG to each primitive of the multiple primitives. The address sent with a FPG determines which fluidic actuator in each primitive is conditionally fired depending on the state of that primitive's fire data. So if, for example, the fluid control data 114 specifies that the fluidic actuator corresponding to address A3 in primitive P2 is to be fired, then during FPG 202 (corresponding to address A3), the fire data for primitive P2 is set active to enable activation of the fluidic actuator corresponding to address A3 in primitive P2.

Generally, a fluidic actuator activates if a) the fluidic actuator's fire data is set active, and b) if the current address matches that of the fluidic actuator's assigned address. A given fluidic actuator in a particular primitive is not activated, if in a current FPG of a column group, either the fire data for the particular primitive is set inactive or a current address for the current FPG does not match the address of the given fluidic actuator.

Although FIG. 2 shows a DBD FPG as having a length larger than that of a normal FPG, it is noted that the longer depicted length of the DBD FPG is used to represent the fact that a DBD measurement process activates a fluidic actuator, waits a specified amount of time, and samples a measurement signal from the sensor associated with the fluidic actuator. In actuality, the DBD FPG may have a time length that is the same as or similar to the time length of a normal FPG.

Also, although FIG. 2 shows the DBD FPG as being at the end of the group of FPGs of each column group, it is noted that the DBD FPG can be provided at a different point relative to the normal FPGs of the column group. For example, the DBD FPG can be provided before the normal FPGs in each column group, or can be provided at any point between the normal FPGs.

In the example of FIG. 2, it is assumed that the fluid control data 114 has selected a fluidic actuator in a particular primitive (hereinafter referred to as the "selected fluidic actuator") corresponding to normal FPG 202 (address A3) in the column group CG1 for activation, and further, that the DBD control engine 112 has decided to perform a DBD measurement of the selected fluidic actuator in the column group CG1. This selected fluidic actuator is also referred to as the A3 selected fluidic actuator, since the fluidic actuator is in the particular primitive (fire data for the particular primitive is set active) and is to be activated by address A3 in the corresponding normal FPG 202.

In a normal operation (i.e., an operation where DBD measurement is not being performed for the column group CG1), the A3 selected fluidic actuator in the column group CG1 would be actuated in the normal FPG 202. However, in accordance with some implementations of the present disclosure, instead of activating the A3 selected fluidic actuator in the normal FPG 202, the selected fluidic actuator of the nozzle 120 is instead activated in the DBD FPG of the column group CG1 to perform a DBD measurement. Effectively, the activation of the selected fluidic actuator has been time shifted (as indicated by 204) from the normal FPG 202 (which is the FPG when the selected fluidic actuator would normally be activated) to the DBD FPG of the column group CG1.

The shifting (204) of the activation of the selected fluidic actuator is performed by a) suppressing activation of the selected fluidic actuator in the normal FPG 202, which is accomplished by the DBD control engine 112 setting the fire data scheduling activation of the selected fluidic actuator in the normal FPG 202 to an inactive value (e.g., set to 0 instead of 1), and b) the DBD control engine 112 setting the data scheduling activation of the selected fluidic actuator in the DBD FPG of the column group CG1 to an active value (e.g., 1), and setting the address to A3 in the DBD FPG in the column group CG1.

In FIG. 2, the shifting (204) of the activation of the selected fluidic actuator for the DBD measurement delays the activation of the selected fluidic actuator. In other examples, if the DBD FPG is placed earlier in the series of FPGs of the column group CG1 than the normal FPG 202, then the shifting (204) causes an earlier activation of the selected fluidic actuator to perform the DBD measurement.

In accordance with some implementations of the present disclosure, a selected fluidic actuator that is to be subject to a DBD measurement is chosen to be one that is already scheduled to fire in one of the normal FPGs corresponding to addresses A0-A7. However, by shifting the activation of the selected fluidic actuator, the selected fluidic actuator is not activated in the corresponding normal FPG, but instead is re-scheduled to be activated in the DBD FPG. Note that the selected fluidic actuator is still activated in the same column group that the selected fluidic actuator is set to be fired based on the fluid control data 114. The activation of the selected fluidic actuator is merely shifted by some amount of time relative to when the selected fluidic actuator was originally scheduled to be activated.

Figure 3:
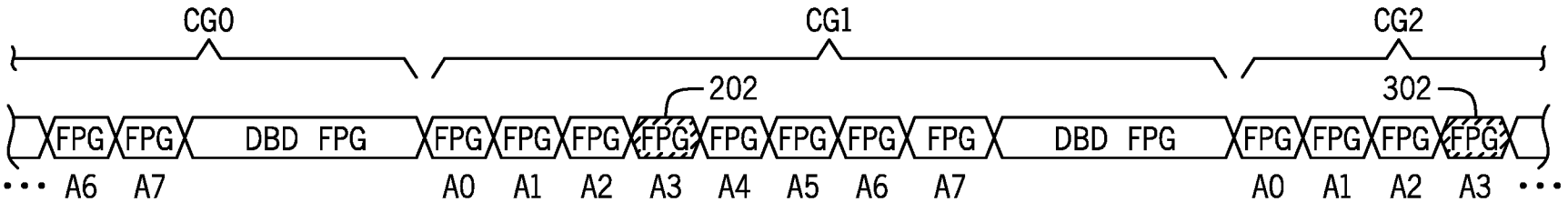

FIG. 3 shows an example timing diagram in which the fluid control data 114 (FIG. 1) indicates that a fluidic actuator corresponding to address A3 is to be activated in both column groups CG1 and CG2. In column group CG1, the normal FPG corresponding to address A3 is identified as 202, and in column group CG2, the normal FPG corresponding to address A3 is identified as 302. If a DBD measurement is performed with respect to the A3 selected fluidic actuator in the DBD FPG in the column group CG1 (such as based on the time shifting 204 in FIG. 2), then a time interval between the DBD FPG of the column group CG1 and the normal FPG 302 of the column group CG2 may violate (i.e., be less than) a minimum time interval between activating a given fluidic actuator in successive column groups. As used here, "successive" column groups refer to a sequence of column groups in which one column group immediately follows another column group (with no intervening column group in between).

The minimum time interval can be set as the time length of a column group.

The minimum time interval between successive activations of a given fluidic actuator in successive column groups is based on fluidic constraints of a corresponding nozzle, which is based on the amount of time involved in filling a fluid chamber of the given nozzle after the fluidic actuator of the given nozzle has been activated. If the given fluidic actuator is activated too soon (i.e., less than the minimum time interval) after a previous activation of the given fluidic actuator, then the fluid chamber of the corresponding nozzle or other flow structure may not have filled properly with fluid, and thus, the fluid dispensing operation of the corresponding nozzle or other flow structure may be sub-optimal.

To address the foregoing issue, in some examples, if the fluid control data 114 schedules activation of the A3 selected fluidic actuator in successive column groups CG1 and CG2, then the DBD control engine 112 can suppress the activation of the A3 selected fluidic actuator in both the normal FPGs 202 and 302, but instead, can activate the A3 selected fluidic actuator in the DBD FPG of one or both of column groups CG1 and CG2.

Alternatively, in response to determining that the fluid control data 114 schedules activation of a particular fluidic actuator in successive column groups, the DBD control engine 112 can decide to not perform a DBD measurement in each of the successive column groups, as doing so would violate the minimum time interval between activation of a fluidic actuator in successive column groups. More generally, the DBD control engine 112 can decide which fluidic actuator to subject to DBD measurement based on the fluid control data 114. In some examples, a fluidic actuator selected for DBD measurement in a particular column group is a fluidic actuator that is not scheduled for activation in successive column groups including the particular column group.

Figure 4:
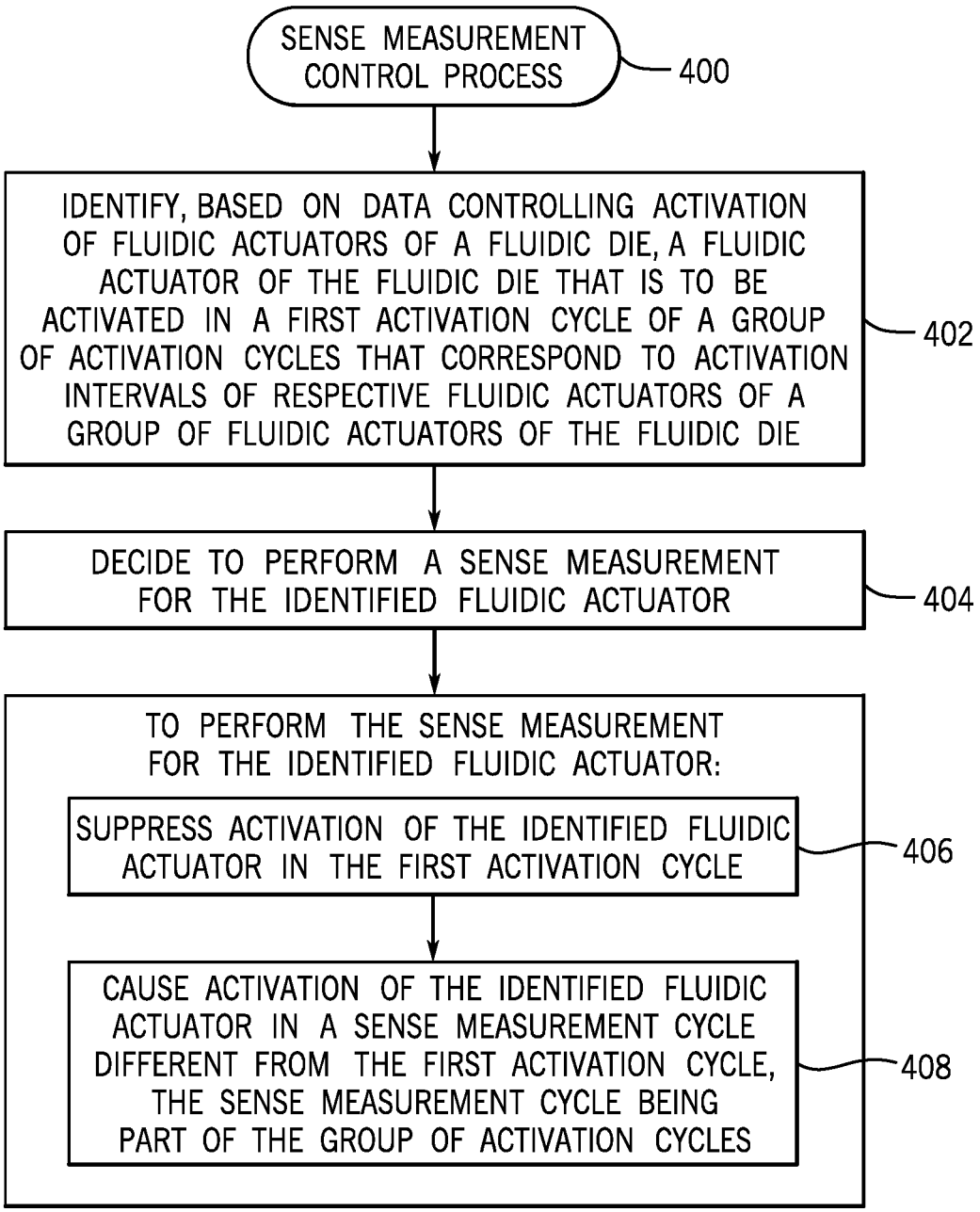
FIG. 4 is a flow diagram of a sense measurement control process, according to some examples.

FIG. 4 is a flow diagram of a sense measurement control process 400, which can be performed by the controller 110 of FIG. 1 according to some examples.

The sense measurement control process 400 identifies (at 402), based on data (e.g., 114 in FIG. 1) controlling activation of fluidic actuators of a fluidic die (or other fluid dispensing device), a fluidic actuator of the fluidic die that is to be activated in a first activation cycle (e.g., a normal FPG selected by one of A0-A7) of a group of activation cycles (e.g., a column group) that correspond to activation intervals of respective fluidic actuators of a group of fluidic actuators (e.g., a primitive) of the fluidic die. The identified fluidic actuator is part of the group of fluidic actuators.

The sense measurement control process 400 decides (at 404) to perform a sense measurement for the identified fluidic actuator.

To perform the sense measurement for the identified fluidic actuator, the sense measurement control process 400 suppresses (at 406) activation of the identified fluidic actuator in the first activation cycle, and causes (at 408) activation of the identified fluidic actuator in a sense measurement cycle (e.g., a DBD FPG) different from the first activation cycle, the sense measurement cycle being part of the group of activation cycles.

Figure 5:
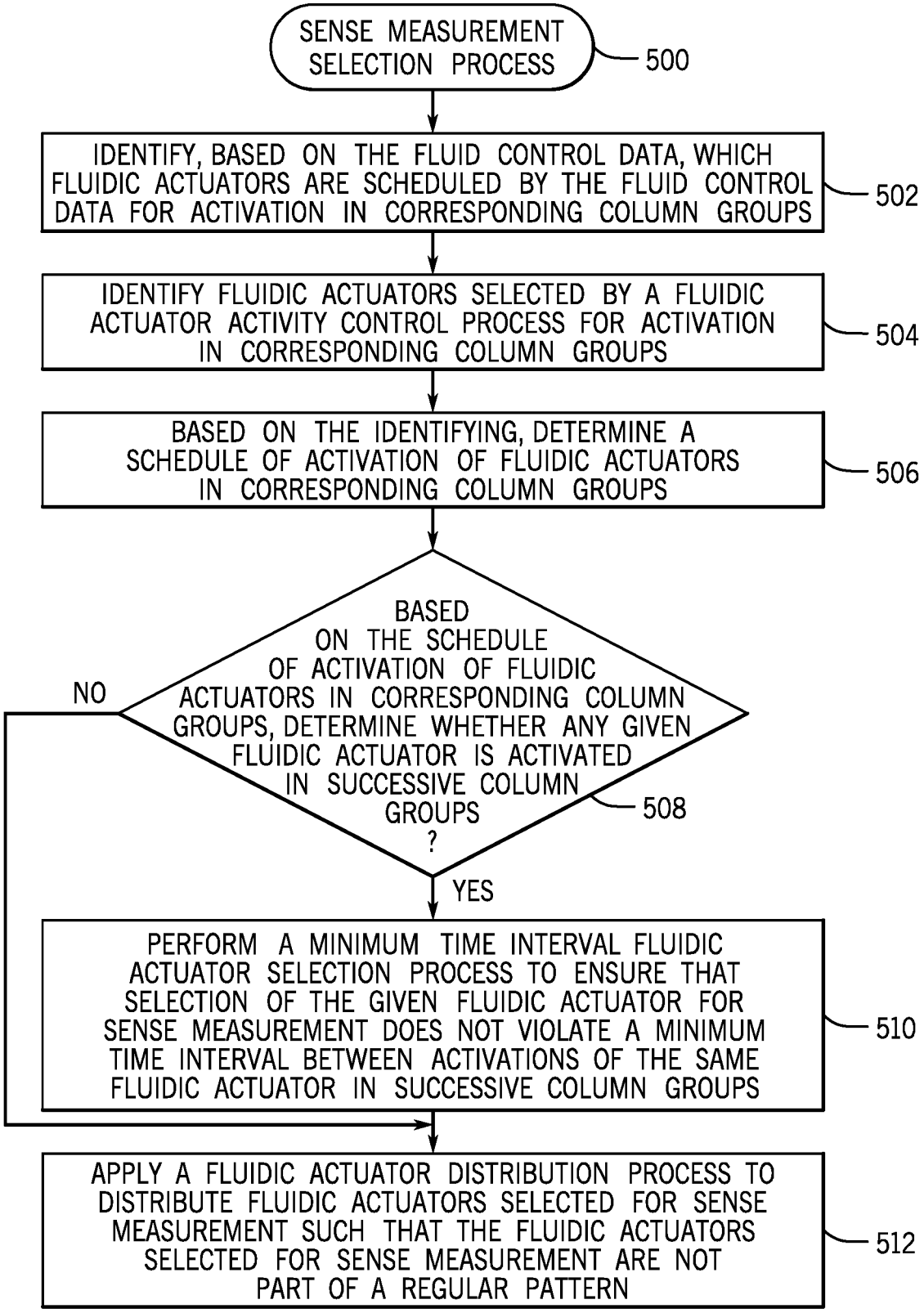
FIG. 5 is a flow diagram of a sense measurement selection process, according to further examples.

FIG. 5 is a flow diagram of a sense measurement selection process 500 for selecting a fluidic actuator that is to be subject to a sense measurement, according to further examples. The sense measurement selection process 500 can be performed by controller 110 in some examples.

The sense measurement selection process 500 identifies (at 502), based on the fluid control data 114, which fluidic actuators are scheduled by the fluid control data 114 for activation in corresponding column groups.

Further, the sense measurement selection process 500 identifies (at 504) fluidic actuators selected by a fluidic actuator activity control process for activation in corresponding column groups. The fluidic actuator activity control process ensures that any given fluidic actuator is not inactive for greater than a specified time duration. An example of the fluidic actuator activity control process is a stochastic spit on page (SOP) process used to maintain nozzle health in printing systems. If a given fluidic actuator is inactive for greater than the specified time duration, then the health of the given fluidic actuator may be adversely affected and the given fluidic actuator may perform in a sub-optimal manner.

Based on the identifying (at 502 and 504), the sense measurement selection process 500 determines (at 506) a schedule of activation of fluidic actuators in corresponding column groups, which is based on the fluid control data 114 and fluidic actuator selection by the fluidic actuator activity control process. These identified fluidic actuators are candidate fluidic actuators that can be subject to sense measurements.

Based on the schedule of activation of fluidic actuators in corresponding column groups, the sense measurement selection process 500 determines (at 508) whether any given fluidic actuator is activated in successive column groups. For each such given fluidic actuator, the sense measurement selection process 500 performs (at 510) a minimum time interval fluidic actuator selection process to ensure that selection of the given fluidic actuator for sense measurement does not violate a minimum time interval between activations of the same fluidic actuator in successive column groups. For example, if the given fluidic actuator is scheduled to be activated in successive column groups CG1 and CG2, then the minimum time interval fluidic actuator selection process can suppress the activation of the given fluidic actuator in both the normal FPGs of the column groups CG1 and CG2, but instead, can activate the given fluidic actuator in the DBD FPG of one or both of column groups CG1 and CG2. Alternatively, in response to determining that the given fluidic actuator is scheduled to be activated in successive column groups, the minimum time interval fluidic actuator selection process can decide to not perform a DBD measurement in each of the successive column groups.

In some examples, the sense measurement selection process 500 also applies (at 512) a fluidic actuator distribution process to distribute fluidic actuators selected for sense measurement such that the fluidic actuators selected for sense measurement are not part of a regular pattern (e.g., fluidic actuators are selected for sense measurements in sequence down a column of fluidic actuators). The shifting of the selected fluidic actuators for performing the sense measurement in respective sense measurement cycles (e.g., DBD FPGs) can cause small artifacts, which may be visible to the human eye in printing applications if the fluidic actuators selected for sense measurements form a regular pattern. To address this, the fluidic actuators are selected to achieve an irregular pattern (e.g., a random pattern) so that artifacts caused by shifting of the timings of fluidic actuator activations become less noticeable. The fluidic actuator distribution process distributes, in an irregular manner, selections of the fluidic actuators for sense measurements.

Figure 6:
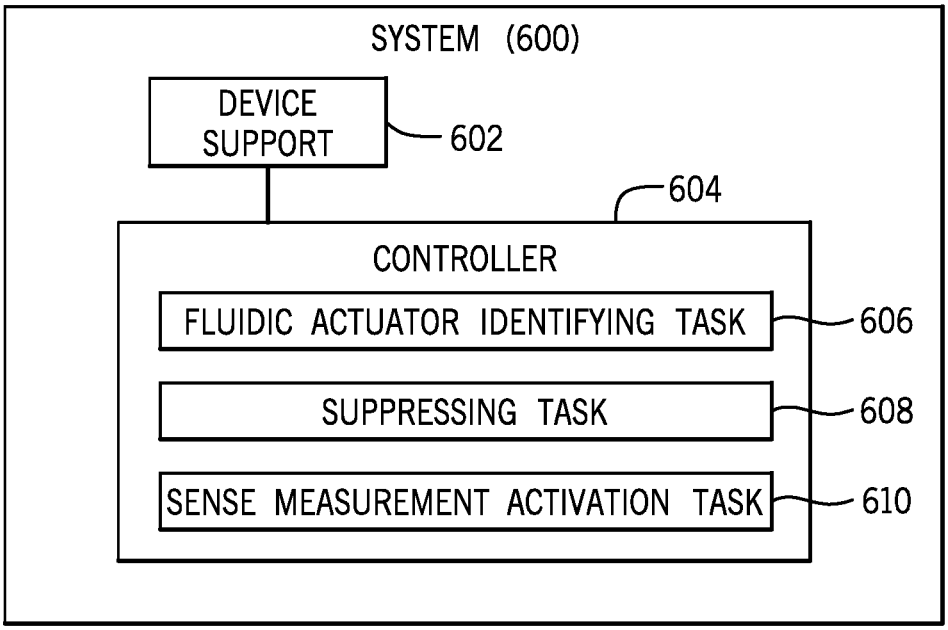
FIG. 6 is a block diagram of a system according to additional examples.

FIG. 6 is a block diagram of a system 600 according to some examples. The system 600 can be a fluid dispensing system. The system 600 includes a device support 602 to receive a fluid dispensing device. The device support 602 can include a carriage, a print bar, a print cartridge, or any other type of mounting structure to which a fluid dispensing device (e.g., a fluidic die) can be fixedly or removably mounted.

The system 600 further includes a controller 604 to perform various tasks. The various tasks can include a fluidic actuator identifying task 606 to identify, based on data controlling activation of fluidic actuators, a fluidic actuator that is to be activated in a first activation cycle of a group of activation cycles that correspond to activation intervals of respective fluidic actuators of a group of fluidic actuators of the fluid dispensing device, the identified fluidic actuator being part of the group of fluidic actuators. The various tasks further include a suppressing task 608 and a sense measurement activation task 610 to perform a sense measurement for the identified fluidic actuator. The suppressing task 608 suppresses activation of the identified fluidic actuator in the first activation cycle, and the sense measurement activation task 610 causes activation of the identified fluidic actuator in a sense measurement cycle different from the first activation cycle, the sense measurement cycle being part of the group of activation cycles.

Figure 7:
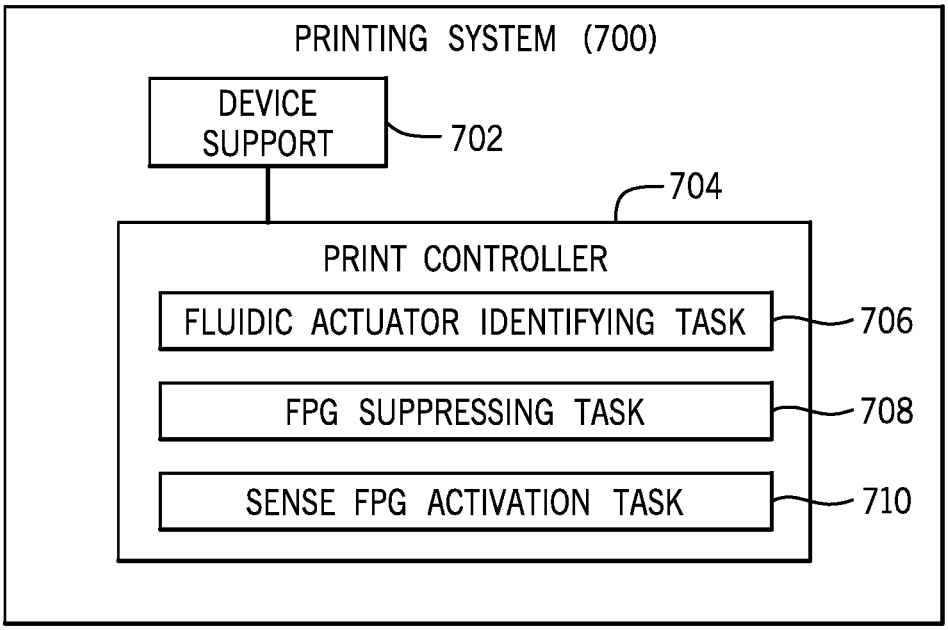
FIG. 7 is a block diagram of a printing system according to yet further examples.

FIG. 7 is a block diagram of a printing system 700 that includes a device support 702 to receive a printhead (e.g., a printhead die). The printing system 700 further includes a print controller 704 to perform various tasks. The various tasks include a fluidic actuator identifying task 706 that identifies, based on data controlling fluidic actuators to be actuated, a fluidic actuator that is to be activated in a first FPG of a print array group comprising FPGs that correspond to activation intervals of respective fluidic actuators of a primitive including plural fluidic actuators of the printhead, the identified fluidic actuator being part of the primitive.

The various tasks further include an FPG suppressing task 708 and a sense FPG activation task 710 to perform a sense measurement for the identified fluidic actuator. The FPG suppressing task 708 suppresses activation of the identified fluidic actuator in the first FPG, and the sense FPG activation task 710 causes activation of the identified fluidic actuator in a sense FPG different from the first FPG, the sense FPG being part of the print array group.

In examples where the controller 110 (FIG. 1), 604 (FIG. 6), or 704 (FIG. 7) is implemented as a combination of a hardware processing circuit and machine-readable instructions, the controller can include a processor and a non-transitory machine-readable or computer-readable storage medium storing machine-readable instructions executable on the processor to perform respective tasks.

A processor can include a microprocessor, a core of a multi-core microprocessor, a microcontroller, a programmable integrated circuit, a programmable gate array, or another hardware processing circuit. Machine-readable instructions executable on a processor can refer to the instructions executable on a single processor or the instructions executable on multiple processors.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A system comprising:

a device support to receive a fluid dispensing device; and a controller to:

identify, based on data controlling activation of fluidic actuators, a fluidic actuator that is to be activated in a first activation cycle of a group of activation cycles that correspond to activation intervals of respective fluidic actuators of a group of fluidic actuators of the fluid dispensing device, the identified fluidic actuator being part of the group of fluidic actuators, and to perform a sense measurement for the identified fluidic actuator:

suppress activation of the identified fluidic actuator in the first activation cycle, and cause activation of the identified fluidic actuator in a sense measurement cycle different from the first activation cycle, the sense measurement cycle being part of the group of activation cycles.

2. The system of claim 1, wherein the data comprises image data that schedules activation of the identified fluidic actuator in the first activation cycle to perform a print operation.

3. The system of claim 1, wherein the data controls activation of selected fluidic actuators to ensure that each fluidic actuator of the selected fluidic actuators is not inactive more than a specified time interval.

4. The system of claim 1, wherein the suppressing of the activation of the identified fluidic actuator in the first activation cycle allows for performance of the sense measurement without causing dispensing of an extra amount of fluid by the identified fluidic actuator when performing the sense measurement.

5. The system of claim 1, wherein activations of the respective fluidic actuators of the group of fluidic actuators are controlled by respective different addresses.

6. The system of claim 1, wherein the controller is to suppress the activation of the identified fluidic actuator in the first activation cycle by setting data scheduling activation of the identified fluidic actuator in the first activation cycle to an inactive value.

7. The system of claim 1, wherein the controller is to:

determine whether the data schedules activation of a particular fluidic actuator in successive groups of activation cycles; and in response to determining that the data schedules activation of the particular fluidic actuator in the successive groups of activation cycles, decide to not perform sense measurement for the particular fluidic actuator in each of the successive groups of activation cycles.

8. The system of claim 1, wherein the group of activation cycles is a first group of activation cycles, and the controller is to:

determine whether the data schedules activation of the identified fluidic actuator in a second group of activation cycles immediately following the first group of activation cycles; and in response to determining that the data does not schedule activation of the identified fluidic actuator in the second group of activation cycles, decide to perform the sense measurement for the identified fluidic actuator in the first group of activation cycles.

9. The system of claim 1, wherein the controller is to:

determine whether the data schedules activation of a particular fluidic actuator in successive groups of activation cycles; and in response to determining that the data schedules activation of the particular fluidic actuator in the successive groups of activation cycles, suppress the activation of the particular fluidic actuator according to the data in the successive groups of activation cycles, and perform a sense measurement for the particular fluidic actuator in one group of the successive groups of activation cycles.

10. The system of claim 1, wherein the controller is to:

distribute, in an irregular manner, selections of fluidic actuators for sense measurements.

11. A printing system comprising:

a device support to receive a printhead; and a print controller to:

identify, based on data controlling fluidic actuators to be actuated, a fluidic actuator that is to be activated in a first fire pulse group (FPG) of a print array group comprising FPGs that correspond to activation intervals of respective fluidic actuators of a primitive including plural fluidic actuators of the printhead, the identified fluidic actuator being part of the primitive, and to perform a sense measurement for the identified fluidic actuator:

suppress activation of the identified fluidic actuator in the first FPG, and cause activation of the identified fluidic actuator in a sense FPG different from the first FPG, the sense FPG being part of the print array group.

12. The printing system of claim 11, wherein the print controller is to:

determine whether the data schedules activation of a particular fluidic actuator in successive print array groups; and in response to determining that the data schedules activation of the particular fluidic actuator in the successive print array groups, decide to not perform sense measurement for the particular fluidic actuator in each of the print array groups.

13. The printing system of claim 11, wherein the print controller is to:

determine whether the data schedules activation of a particular fluidic actuator in successive print array groups; and in response to determining that the data schedules activation of the particular fluidic actuator in the successive print array groups, suppress the activation of the particular fluidic actuator according to the data in the successive print array groups, and perform a sense measurement for the particular fluidic actuator in one group of the successive print array groups.

14. A method comprising:

identifying, by a controller based on data controlling activation of fluidic actuators of a fluidic die, a fluidic actuator of the fluidic die that is to be activated in a first activation cycle of a group of activation cycles that correspond to activation intervals of respective fluidic actuators of a group of fluidic actuators of the fluidic die, the identified fluidic actuator being part of the group of fluidic actuators;

deciding, by the controller, to perform a sense measurement for the identified fluidic actuator;

to perform the sense measurement for the identified fluidic actuator, the controller suppressing activation of the identified fluidic actuator in the first activation cycle, and causing activation of the identified fluidic actuator in a sense measurement cycle different from the first activation cycle, the sense measurement cycle being part of the group of activation cycles.

15. The method of claim 14, wherein the deciding of whether to perform the sense measurement for the identified fluidic actuator is based on determining fluidic actuators that are to be activated based on the data.

* * * * *